US005934236A

United States Patent [19]

Rao et al.

[11] Patent Number: 5,934,236

[45] **Date of Patent: *Aug. 10, 1999**

[54] LOW FRICTION VALVE TRAIN

[75] Inventors: V. Durga Nageswar Rao, Bloomfield Hills; Daniel Michael Kabat, Oxford; Harry Arthur Cikanek, Northville, all of Mich.

[73] Assignee: Ford Global Technologies, Inc., Dearborn, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/183,464

[22] Filed: Jan. 19, 1994

Related U.S. Application Data

[63] Continuation-in-part of application No. 07/975,320, Nov. 12, 1992, abandoned.

[51] Int. Cl.[6] ..... F01L 1/02

[52] U.S. Cl. ..... 123/90.51; 123/90.33; 123/90.6; 123/188.9

[58] Field of Search ..... 123/90.27, 90.33, 123/90.34, 90.48, 90.51, 90.6, 188.3, 188.5, 188.9; 74/567, 569

[56] References Cited

U.S. PATENT DOCUMENTS

| | | | |
|---|---|---|---|
| Re. 33,888 | 4/1992 | Hartnett et al. | 29/888.1 |
| Re. 34,143 | 12/1992 | Rao et al. | 123/193.4 |
| 3,303,833 | 2/1967 | Melling | 123/90.48 |
| 3,958,541 | 5/1976 | Lachnit | 123/90.34 |
| 4,153,017 | 5/1979 | Behnke | 123/90.51 |
| 4,312,900 | 1/1982 | Simpson | 427/181 |
| 4,366,785 | 1/1983 | Goloff et al. | 123/90.51 |
| 4,367,701 | 1/1983 | Buente | 123/90.55 |
| 4,430,970 | 2/1984 | Holtzberg et al. | 123/90.51 |
| 4,558,960 | 12/1985 | Lehtinen et al. | 384/373 |
| 4,594,973 | 6/1986 | Allred et al. | 123/90.4 |
| 4,644,912 | 2/1987 | Umeha et al. | 123/90.34 |
| 4,777,842 | 10/1988 | Yamada | 74/567 |
| 4,781,075 | 11/1988 | Yamaji et al. | 74/567 |
| 4,796,575 | 1/1989 | Matsubara et al. | 123/90.44 |
| 4,835,832 | 6/1989 | Arnold et al. | 29/523 |
| 4,871,266 | 10/1989 | Oda | 384/42 |
| 4,872,432 | 10/1989 | Rao et al. | 123/193 CP |
| 4,873,150 | 10/1989 | Doi et al. | 123/90.39 |
| 4,909,198 | 3/1990 | Shiraya et al. | 123/90.51 |
| 4,917,953 | 4/1990 | Hioki et al. | 428/408 |
| 4,922,785 | 5/1990 | Arnold et al. | 74/567 |
| 4,969,262 | 11/1990 | Hiraoka et al. | 29/888.1 |
| 4,993,282 | 2/1991 | Swars | 74/567 |
| 4,995,281 | 2/1991 | Allor et al. | 74/559 |

(List continued on next page.)

FOREIGN PATENT DOCUMENTS

| | | |
|---|---|---|
| 0030780 | 6/1981 | European Pat. Off. . |
| 0067327 | 12/1982 | European Pat. Off. . |
| 0391499 | 10/1990 | European Pat. Off. . |
| 3239325 | 4/1984 | Germany . |
| 58-214609 | of 1982 | Japan . |
| 59-37217 | 2/1984 | Japan . |
| 3-15609 | 1/1991 | Japan . |
| 1102066 | 2/1968 | United Kingdom . |
| 1152957 | 5/1969 | United Kingdom . |
| 1462766 | 1/1977 | United Kingdom . |
| 2093554 | 9/1982 | United Kingdom . |
| 2242240 | 9/1991 | United Kingdom . |
| 2249811 | 11/1991 | United Kingdom . |
| 2272029 | 5/1994 | United Kingdom . |
| 2273139 | 6/1994 | United Kingdom . |

*Primary Examiner*—Weilun Lo
*Attorney, Agent, or Firm*—Joseph W. Malleck

[57] ABSTRACT

A low friction valve train actuating at least one valve in an internal combustion engine includes a cam shaft having at least one cam, a tappet contacting the cam and valve, the cam and valve having outer surfaces with an open porosity, a solid film lubricant impregnated and anchored in the open porosity, the solid film lubricant is stable to temperatures at about 700° F. to retain a low coefficient of friction in an oil starved environment.

14 Claims, 3 Drawing Sheets

U.S. PATENT DOCUMENTS 5,007,165 4/1991 Podhorsky ..... 29/888.1
5,029,562 7/1991 Kamo ..... 123/193 P
5,035,959 7/1991 Ito et al. ..... 428/627
5,040,501 8/1991 Lemelson ..... 123/188 AA
5,041,168 8/1991 Purnell et al. ..... 148/13.2
5,052,352 10/1991 Taniguchi et al. ..... 123/90.39
5,054,440 10/1991 Kadokawa ..... 123/90.5
5,060,607 10/1991 Taniguchi ..... 123/90.51
5,063,894 11/1991 Mielke et al. ..... 123/193 P
5,066,145 11/1991 Sibley et al. ..... 384/463
5,067,369 11/1991 Taniguchi ..... 74/567
5,101,554 4/1992 Breuer et al. ..... 29/888.1
5,197,351 3/1993 Hishida ..... 74/567
5,237,967 8/1993 Willermet et al. ..... 123/90.48
5,245,888 9/1993 Tsuzuki et al. ..... 74/567

Fig-1
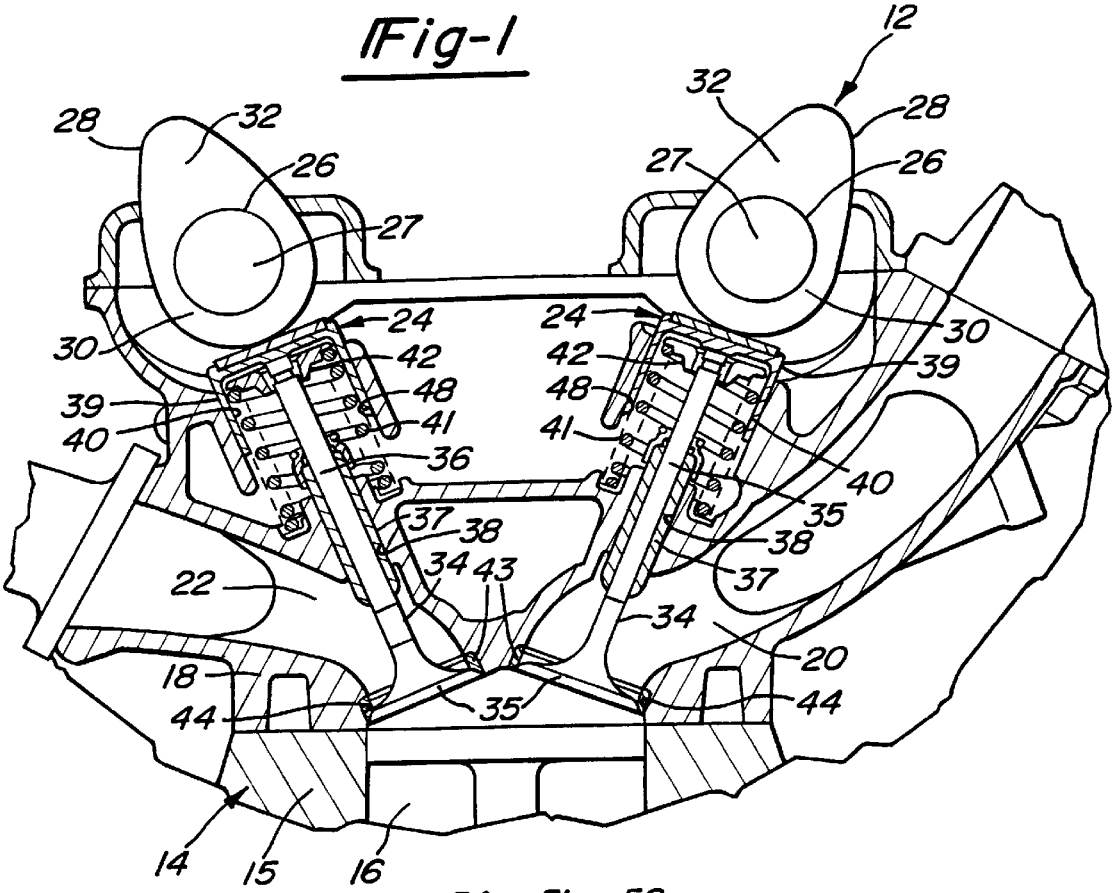
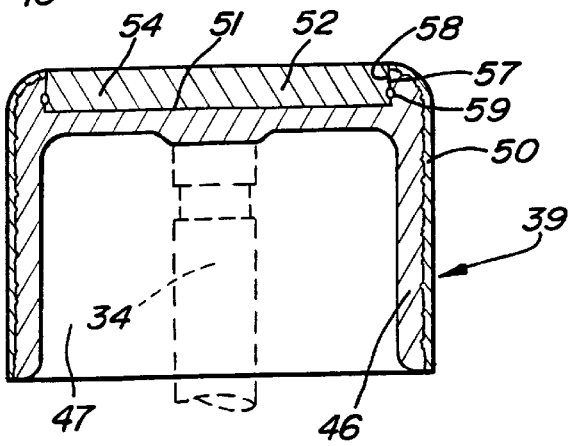
Fig-2

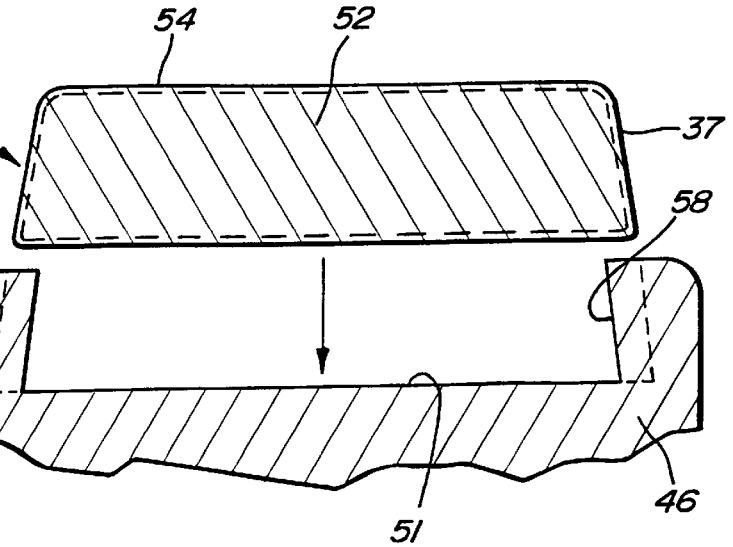
Fig-3
Fig-4
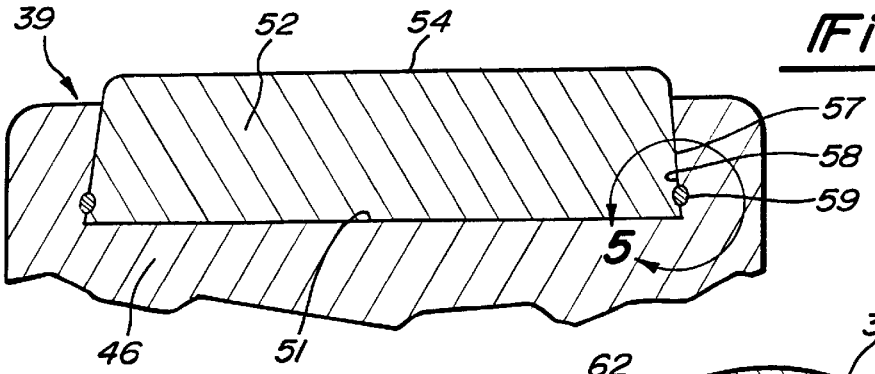
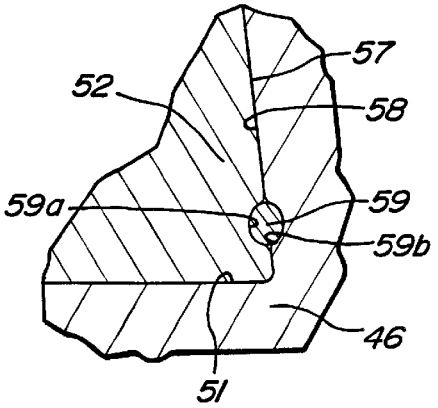
Fig-5
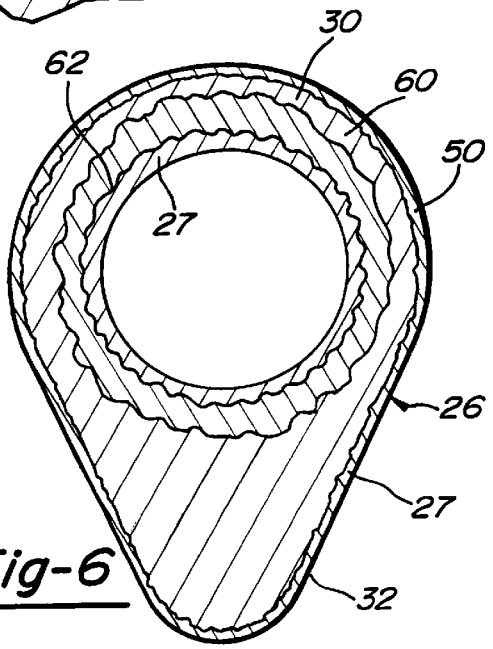
Fig-6

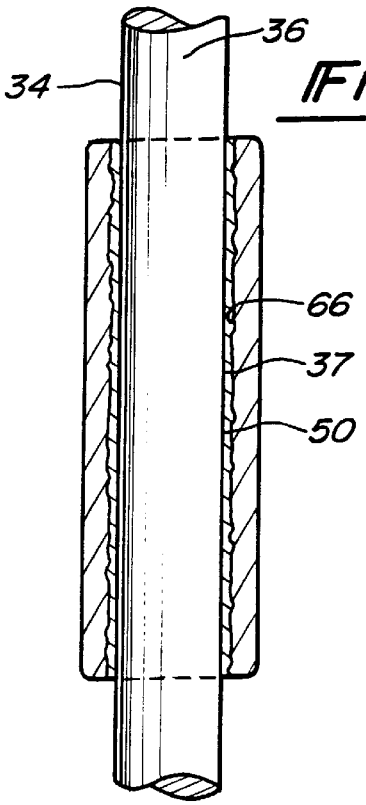
Fig-7
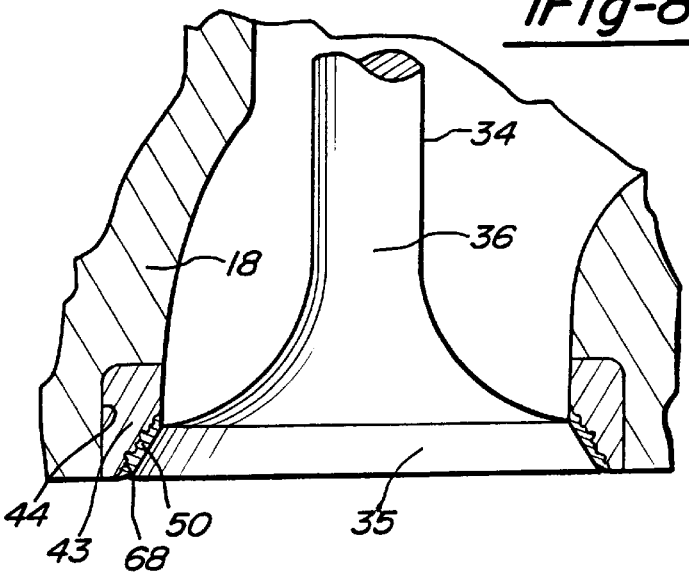
Fig-8
Fig-9
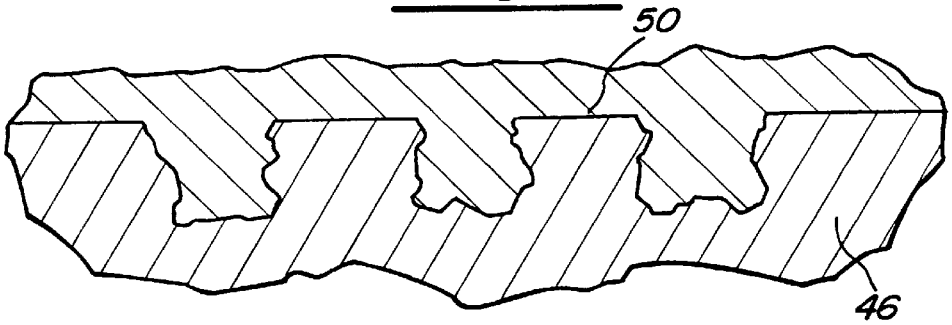
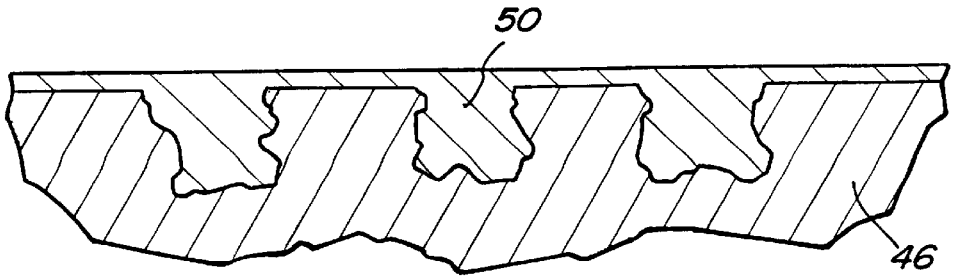
Fig-10

LOW FRICTION VALVE TRAIN

CROSS-REFERENCE TO RELATED APPLICATION(S)

This application is a continuation-in-part of U.S. application Ser. No. 07/975,320, filed Nov. 12, 1992, now abandoned.

BACKGROUND OF THE INVENTION

1. Field of the Invention

The present invention relates generally to internal combustion engines and, more particularly to, a low friction valve train for an internal combustion engine.

2. Description of the Related Art

It is known to construct valve trains for opening and closing valves in engines such as internal combustion engines. Such a valve train may be a direct acting hydraulic bucket tappet valve train for an overhead cam type internal combustion engine. Generally, the valve train includes a tappet which contacts a cam on a cam shaft which is used to translate rotational motion of the cam shaft into axial motion of the valve. The valve is closed by a valve spring which biases the valve in a closed position.

The valve train includes a hydraulic lash adjuster which compensates for a change in valve length due to thermal expansion caused by temperature changes as well as valve seat wear. This type of valve train is a high pressure system which, through hydraulic pressure generated by the lubrication system, keeps the valve lifter in proper contact with the cam to perform the valve opening/closing function. The constant hydraulic pressure continuously applied to the valve to maintain proper contact with the cam, in addition to the forces induced by the cam, results in increased friction losses and significant wear to the components of the valve train.

However, the hydraulic pressure is expected to provide hydrodynamic film lubrication between a journal of the cam and bearing surfaces of the cam shaft, and the tappet surface and the cam surfaces. Because of high unit loads, the valve train operates in a predominately boundary/mixed lubrication regime, particularly in the 750–2000 engine speed range. This speed range represents more than 80% of the driving cycle for passenger vehicle operation. Because the operation is in the predominantly boundary/mixed lubrication regime, the contacting components are subject to significant wear, as much as 30 to 150 microns on the cam during the life of the engine.

Additionally, engine speed is limited by the incidence of "valve toss" which is due to the reciprocating mass of the valve train. Reducing the valve train mass decreases the forces due to inertia and, as a result, permits higher engine operating speeds which, in turn, result in greater engine output. Further, reducing the friction between the moving components significantly reduces the wear and eliminates the need for a heavy, complex and expensive hydraulic system and enables the engine to operate at normal hydraulic pressures without the friction losses and corresponding wear encountered in standard hydraulic systems. The reduction in friction, in turn, results in fuel economy improvement and the reduction in wear improves component durability and, as a consequence, engine life. Thus, there is a need in the art to reduce the mass of the valve train and friction between moving components of the valve train.

SUMMARY OF THE INVENTION

Accordingly, the present invention is a unique low friction valve train actuating at least one valve in an internal combustion engine. In general, the low friction valve train includes a cam shaft having at least one cam and a tappet contacting the cam and valve. The cam and valve have outer surfaces with an open porosity. The low friction valve train also includes a solid film lubricant impregnated and anchored in the open porosity. The solid film lubricant is stable to temperatures at about 700° F. to retain a low coefficient of friction in an oil starved environment.

Additionally, the tappet includes an insert which contacts the cam. The insert of the tappet includes a wear resistant contact surface. Further, a valve guide has an inner surface treated to create an open porosity and impregnated with the solid film lubricant to reduce the friction at the valve/valve guide interface.

One advantage of the present invention is that a low friction valve train is provided for an internal combustion engine. Another advantage of the present invention is that a solid film lubricant is applied to the contacting surfaces of the valve train, thereby reducing contact pressures which correspondingly reduces friction and wear. Yet another advantage of the present invention is that the valve train incorporates a solid film lubricant to avoid the frictional losses occurring as a result of hydraulic loading of the tappet against the cam. A further advantage of the present invention is that the solid film lubricant applied to components of the valve train results in the frictional losses and corresponding wear being significantly reduced, thereby obviating the need for a heavy, complex and expensive hydraulic system. Additionally, such a low friction valve train will reduce or eliminate wear during oil starved conditions such as cold start and, thus, increase component and engine life significantly.

Other features and advantages of the present invention will be readily appreciated as the same becomes better understood after reading the following description in conjunction with the accompanying drawings.

BRIEF DESCRIPTION OF THE DRAWINGS

FIG. 1 is a partial fragmentary view of a low friction valve train, according to the present invention, illustrated in operational relationship to an engine.

FIG. 2 is an enlarged view of a tappet assembly for the low friction valve train of FIG. 1.

FIG. 3 is an exploded view of a portion of the tappet assembly of FIG. 2.

FIG. 4 is an enlarged view of the portion of the tappet assembly of FIG. 3 as assembled.

FIG. 5 is an enlarged view of a portion in circle 5 of FIG. 4.

FIG. 6 is an enlarged view of a cam for the low friction valve train of FIG. 1.

FIG. 7 is an enlarged view of a valve and valve guide for the low friction valve train of FIG. 1.

FIG. 8 is an enlarged view of a valve and valve seat for the low friction valve train of FIG. 1.

FIG. 9 is an enlarged view of a portion of the low friction valve train of FIG. 1 prior to break-in.

FIG. 10 is a view similar to FIG. 9 after break-in.

DESCRIPTION OF THE PREFERRED EMBODIMENT(S)

Referring to the drawings and in particular FIG. 1 thereof, a low friction valve train 12, accordingly to the present invention, is illustrated in operational relationship to an internal combustion engine, generally indicated at 14. The engine 14 includes a cylinder or engine block 15 having at least one, preferably a plurality of hollow cylinders 16 therein. The engine 14 also includes a cylinder or engine head 18 secured to the cylinder block 15 by suitable means such as fasteners (not shown). The cylinder head 18 has an intake passageway 20 and an exhaust passageway 22 communicating with the cylinders 16.

The low friction valve train 12 includes at least one, preferably a plurality of valve assemblies, generally indicated at 24 for opening and closing the intake passageway 20 and exhaust passageway 22. Preferably, separate valve assemblies 24 are used for the intake passageway 20 and the exhaust passageway 22. The low friction valve train 12 also includes at least one, preferably a plurality of cam shafts 26 for opening and closing the valve assemblies 24. The cam shaft 26 includes a shaft member 27 rotatably supported within the cylinder head 18 as is known in the art. The cam shaft 26 has at least one, preferably a plurality of cams 28 which contact and move the valve assemblies 24. The cams 28 have a base circle portion 30 and a lobe portion 32.

Each valve assembly 24 includes a valve 34 having a head portion 35 and a stem portion 36 slidably disposed in a valve guide 37. The valve guide 37 is disposed in an aperture 38 of the cylinder head 18 as is known in the art. The valve assembly 24 also includes a tappet assembly 39 contacting one end of the stem portion 35 of the valve 34 and engaging a cam 28 of the cam shaft 26. The tappet assembly 39 is slidably disposed in a tappet guide aperture 40 of the cylinder head 18 as is known in the art. The valve assembly 24 further includes a valve spring 41 disposed about the stem portion 35 of the valve 34 and having one end contacting the cylinder head 18 and the other end contacting a valve spring retainer 42 disposed about the stem portion 35. The valve spring 41 urges the head portion of the valve 34 into engagement with a valve seat 43 to close a corresponding intake or exhaust passageway 20, 22. The valve seat 43 is disposed in a recess 44 of the cylinder head 18 at the end of the intake or exhaust passageway 20, 22 adjacent the cylinder 16.

Referring now to FIG. 2, a tappet assembly 39, according to the present invention, is illustrated. The tappet assembly 39 includes a tappet body 46 which is generally cylindrical in shape and having a hollow interior 47 to receive the stem portion 35 of the valve 34. Preferably, the tappet body 46 is made from a metal material such as a die cast high strength aluminum or magnesium alloy. The outer periphery or surface of the tappet body 46 is hard anodized. The anodizing process results in a coating which is submicroscopically porous, e.g., a pore size of approximately 3–10 microns, for allowing a solid film lubricant 50 to be impregnated within the tappet body 46 prior to finish grinding. It is important that the depth of the anodized layer be adequate, approximately 30–40 microns, to support the bearing loads. Also, the anodizing process should produce a suitable anodized layer of sufficient depth and integrity that it does not crumble under fatigue loading. The solid film lubricant 50 must be impregnated to a depth of at least a few microns greater than the expected wear, e.g., if expected wear is around 30 microns then a solid film lubricant impregnation to approximately 35–40 microns is satisfactory.

The solid film lubricant 50, as used herein, is a solid film lubricant that is stable to temperatures at about 700° F. to retain a low coefficient of friction, e.g. 0.02–0.1 at 600° F., for an oil starved environment of the low friction valve train 10. The solid film lubricant 50 is preferably a composite of graphite, such as by volume of 40%, at least one lubricant solid, such as $MoS_2$ by volume of 20%, and a substance that replaces or replenishes loss of occluded water and hydrocarbon (HC) molecules in the graphite platelets at temperatures greater than 400° F. Preferably, the substance is a thermally stable (does not decompose up to and including 375° C. or 700° F.) polymer such as polyarylsufone or a high temperature epoxy such as bisphenol A and vinyl butoryl combined with dicyandianide. The solid film lubricant 50 has at least 5% up to and including 30% by volume of the polymer or epoxy. The polymer or epoxy should be present in a sufficient amount to cover or form a thin film around the graphite particles. The porous structure that is impregnated with the solid film lubricant 50 must have a porosity sufficient to accept five (5) microns or less of particle size of the polymer or epoxy. It should be appreciated that the solid film lubricant 50 is anchored in the porous structure. It should also be appreciated that the porous structure will allow the ratio of polymer/epoxy to lubricant solids to be no greater than 30:70.

The solid film lubricant 50 may also be a metal matrix composite having about 40% graphite and the remainder aluminum or cast iron. Such metal matrix composite may be formed by powder metallurgy or other suitable means to provide a porous material that can expose graphite for intermittent or supplementary lubrication purposes.

Up to 13% of the graphite may be substituted with another lubricant solid such as boron nitride. The solid film lubricant 50 may also include other lubricant solids such as up to 10% copper and one of LiF, NaF, and CaF as a substitute for the $MoS_2$. It should be appreciated that other compositions suitable as solid film lubricants may also be used.

The solid film lubricant 50 of the type described here promotes rapid stable oil film formation due to its affinity for conventional lubricating oils. To impregnate the porous structure with the solid film lubricant 50, the porous structure is infiltrated with the solid film lubricant 50 by conventional methods and the porosity is filled and closed. As a result, the solid film lubricant 50 is anchored in the porous structure. During frictional contact, the polymer of the solid film lubricant 50 melts and is drawn to the outer surface to form a thin film with conventional lubricating oils to retain a low coefficient of friction in an oil starved environment.

As illustrated in FIGS. 2 through 5, the tappet assembly 39 also includes a cavity 51 at an upper end thereof. The cavity 51 is generally cylindrical in shape. The tappet assembly 39 also includes a wear resistant insert 52 having a contacting surface 54 which contacts a cam 28 on the cam shaft 26. Preferably, the insert 52 is made of ceramic material but may also be manufactured from a high strength steel, toughened alumina or silicon nitride sintered. The insert 52 is machined to fit in the cavity 51 of the tappet body 46. The insert 52 and cavity 51 are matched for a smooth fit. Preferably, the sides of the insert 52 and the cavity 51 include complementary inverse tapers 57 and 58, respectively, to lock the insert 52 within the cavity 51. The insert 52 is secured within the cavity 51 through a shrink-fit process. The shrink-fit process includes heating the tappet body 46 to a temperature approximately 100° F. higher than the engine operating temperature (approximately 310° F.), and cooling the insert 52 to a temperature below a low end ambient temperature (approximately −50° F.) after which the insert 52 is placed in the cavity 51. When the tappet assembly 39 is brought to room temperature, the tappet body 46 shrinks around the insert 52 because of the significantly higher thermal expansion of the tappet body 46 relative to that of the insert 52. This process insures that the insert 52 remains in compression during the entire operating range of engine temperatures. It should be appreciated that the insert 52 may also be secured to the tappet body 46 through use of a lock ring 59 engaging corresponding annular grooves 59*a* and 59*b* formed in both the insert 52 and the tappet body 46, respectively.

Referring to FIG. 6, a cam 28 of the cam shaft 26 is shown. The base circle portion 30 of the cam 28 includes an interior portion 60 made from a metal material of a soft/low carbon steel to minimize stresses occurring during rotation of the cam shaft 26. The interior portion 60 is mechanically secured to a fluted or roughened portioned 62 of the shaft 27. The lobe portion 32 and the remaining portion of the base circle portion 30 of the cam 28 are made from a metal material such as a porous medium/high carbon Ni—Cr alloy steel. The outer periphery or surfaces of the base circle portion 30 and lobe portion 32 are hardened to a normally specified hardness level for a cam surface (usually around Rc 55) utilizing any one of the well known processes, e.g. carbo nitrating. Generally, the porosity extends only to a depth of less than 1.0 mm. The porosity enables the outer surfaces of the cam 28 to be impregnated with the solid film lubricant 50 as previously described. The depth of the solid film lubricant 50 impregnation should be at least a few microns greater than the expected wear as previously described.

Referring to FIG. 7, the valve guide 37 is shown. The valve guide 37 has an inner surface 66 impregnated with the solid film lubricant 50, as previously described, to reduce the friction between the stem portion 35 of the valve 34 and the valve guide 37. Preferably, the inner surface 66 of the valve guide 37 includes a wear resistant porous layer formed by a suitable means to facilitate impregnation of the solid film lubricant 50 as previously described.

Referring to FIG. 8, the valve seat 43 is shown. The valve seat 43 has an outer surface 68 also impregnated with the solid film lubricant 50, as previously described, to reduce the friction and corresponding wear occurring between the head portion 35 and valve seat 43. Alternatively, the outer surface of the head portion 35 of the valve 34 may be impregnated with the solid film lubricant 50 and the head portion 35 may be hollow with a wear resistant insert at the lower end thereof. It should be appreciated that the valve seat 43 is treated to form a wear resistant porous layer as previously described.

Referring to FIG. 9, a portion of the solid film lubricant 50 on a corresponding valve train component such as the tappet body 46 prior to break in is illustrated. The solid film lubricant 50 is impregnated to an effective wear depth and includes a superficial layer. After engine break in, the layer of solid film lubricant 50 forms a stable low friction wear resistant film as illustrated in FIG. 10.

In operation, the solid film lubricant 50 promotes the formation of a stable lubrication film. The stable lubrication film reduces friction occurring at higher operating speeds where hydrodynamic lubrication is predominate. Rapid formation of a lubrication film significantly reduces cam wear by reducing the friction at lower engine speeds.

Accordingly, the solid film lubricant 50 on the low friction valve train 10 reduces friction losses, the contact forces due to the elimination of hydraulic loading, and reduces inertia forces due to a significant reduction in the reciprocating mass. As a result, the low friction valve train 10 permits significantly higher engine operating speeds and a reduction in friction and wear which extends corresponding engine life. Because of the significantly reduced wear, the low friction valve train 10 does not require adjustment for life of the engine nor does it require a hydraulic lash adjustment and the attendant precision machining and hydraulic lubrication requirements. A high pressure hydraulic system is not required as normal lubrication provides satisfactory operation and avoids the friction losses encountered in hydraulic systems due to hydraulic loading of the tappet against the cam.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A low friction valve train actuating at least one valve in an internal combustion engine comprising:

a cam shaft having at least one cam; and a tappet contacting said at least one cam and valve, said at least one cam and tappet having outer surfaces with an open porosity of at least five microns; and a solid film lubricant comprised of graphite up to approximately forty percent by volume, at least one solid lubricant up to approximately twenty percent by volume, and a substance that replenishes loss of occluded water and hydrocarbon molecules in said graphite at temperatures greater than 400° F. from approximately five percent up to approximately thirty percent by volume, said open porosity allowing a ratio of said substance to said solid lubricant to be no greater than 30:70, said solid film lubricant being impregnated and anchored in said open porosity, said solid film lubricant being stable to temperatures at about 700° F. to retain a low coefficient of friction of approximately 0.02 to 0.1 at 600° F. and promote rapid formation of a stable oil film to reduce friction therebetween in an oil starved environment.

2. A low friction valve train as set forth in claim 1 wherein said at least one lubricant solid comprises at least one of boron nitride, molybdenum disulfide, copper, LiF, NaF and CaF.

3. A low friction valve train as set forth in claim 1 including a valve seat in the engine for the valve, said valve seat having an outer surface to contact the valve, the outer surface having an open porosity, said solid film lubricant being impregnated and anchored in said open porosity.

4. A low friction valve train as set forth in claim 1 including a valve guide disposed about the valve, wherein the valve is slidably disposed in said valve guide, said valve guide having an inner surface adjacent the valve, said inner surface impregnated with said solid film lubricant.

5. A low friction valve train as set forth in claim 1 wherein said outer surfaces of said at least one cam are made from a porous medium to high carbon Ni—Cr alloy steel.

6. A low friction valve train as set forth in claim 1 wherein said tappet is made from at least one material selected from the group comprised of magnesium and aluminum.

7. A low friction valve train as set forth in claim 1 wherein said tappet includes means forming a cavity and a wear resistant insert disposed in said cavity to contact said at least one cam.

8. A low friction valve train as set forth in claim 7 wherein said wear resistant insert is made from at least one material selected from the group comprised of silicon nitride, toughened alumina or hardened porous Ni—Cr alloy steel.

9. A low friction valve train as set forth in claim 7 wherein said cavity has an inwardly tapered side wall and said wear resistant insert has inwardly tapered sides cooperating with said inwardly tapered side wall to secure said wear resistant insert to said tappet.

10. A low friction valve train as set forth in claim 7 including a locking ring disposed between said wear resistant insert and said tappet to secure said wear resistant insert to said tappet.

11. A low friction valve train actuating at least one valve in an internal combustion engine comprising:

a cam shaft having at least one cam with a base portion and lobe portion, said base and lobe portions having outer surfaces treated such that the treated surfaces have an open porosity of at least five microns;

a tappet having an outer surface treated such that the treated surface has an open porosity, said tappet further including a wear resistant insert secured to said tappet and contacting said at least one cam; and a solid film lubricant comprised of graphite up to approximately forty percent by volume, at least one solid lubricant from a group comprising $MoS_2$, boron nitride, Cu, LiF, NaF, and CaF up to approximately twenty percent by volume, and either one of a thermally stable polymer and epoxy that replenishes loss of occluded water and hydrocarbon molecules in said graphite at temperatures greater than 400° F. from approximately five percent up to approximately thirty percent by volume, said open porosity allowing a ratio of said polymer/epoxy to said solid lubricant to be no greater than 30:70, said solid film lubricant being impregnated and anchored in said open porosity of said treated surfaces of said base portion and said lobe portion and said tappet, said solid film lubricant being stable to temperatures at about 700° F. to retain a low coefficient of friction and promote rapid formation of a stable oil film to reduce friction therebetween in an oil starved environment.

12. A low friction valve train as set forth in claim 11 including a valve guide surrounding the valve, the valve guide having an inner surface, said inner surface impregnated with said solid film lubricant.

13. A low friction valve train as set forth in claim 11 wherein the engine includes a cylinder head having a valve seat, said valve seat being impregnated with said solid film lubricant.

14. A low friction valve train actuating at least one valve in an internal combustion engine comprising:

a cam shaft having at least one cam surface made from a porous medium to high carbon Ni—Cr alloy steel; and a tappet having an outer surface contacting said at least one cam and valve, said outer surfaces of said at least one cam and tappet having an open porosity of at least five microns and being impregnated with a solid film lubricant comprised of graphite up to approximately forty percent by volume and at least one of boron nitride and molybdenum disulfide up to approximately twenty percent by volume in either one of a high temperature polymer and epoxy base that replenishes loss of occluded water and hydrocarbon molecules in said graphite at temperatures greater than 400° F. from approximately five percent up to approximately thirty percent by volume, said open porosity allowing a ratio of said polymer/epoxy to said graphite/boron nitride/molybdenum disulfide to be no greater than 30:70, the solid film lubricant has an affinity for oil and promotes rapid formation of a stable oil film to reduce friction therebetween in an oil starved environment.

* * * * *